US005482269A

United States Patent [19]

Scott et al.

[11] Patent Number: 5,482,269

[45] Date of Patent: Jan. 9, 1996

[54] DRIVING RANGE TEE AREA DIVING METHOD

[76] Inventors: Ralph M. Scott, 3901 Chadbury Rd., Mount Laurel, N.J. 08054; John C. Scarperia, 81 N. Church St., Beverly, N.J. 08010

[21] Appl. No.: 370,864

[22] Filed: Jan. 10, 1995

[51] Int. Cl.[6] ..... A63B 57/00; A63B 67/02

[52] U.S. Cl. ..... 273/35 B; 273/176 A; 273/33; 273/181 F; 273/407; 273/32 B; 160/351

[58] Field of Search ..... 273/35 B, 176 R, 273/176 A, 176 AA, 176 AB, 176 E, 176 F, 176 FA, 176 FB, 176 G, 176 H, 176 J, 33, 181 F, 407, 32 R, 32 B

[56] References Cited

U.S. PATENT DOCUMENTS

| | | | |
|---|---|---|---|
| 1,852,948 | 4/1932 | Warren et al. | 273/176 A |
| 3,620,536 | 11/1971 | Lau | 273/176 A |
| 4,014,521 | 3/1977 | Berman | 273/29 B X |
| 4,063,738 | 12/1977 | Michalson | 273/176 A |
| 4,085,789 | 4/1978 | Steiner et al. | 160/351 X |
| 4,134,439 | 1/1979 | Scott | 160/351 X |
| 4,842,035 | 6/1989 | Thompson | 160/351 X |
| 4,948,141 | 8/1990 | Newman | 273/176 FA |
| 5,213,312 | 5/1993 | MacDonald | 160/351 X |

*Primary Examiner*—George J. Marlo

*Attorney, Agent, or Firm*—John F. A. Earley; John F. A. Earley, III

[57] ABSTRACT

A tee divider and method for dividing a tee area of a golf driving range into subsections and for blocking golf balls errantly hit by a first golfer from hitting a second golfer practicing next to the first golfer, comprises a frame having an upper end portion and a lower end portion, mounting feet mounted on the lower end portion of the frame for securing the tee divider on the tee area and for supporting the tee divider in an upright position substantially perpendicular to the plane of the tee area, a deflector sheet extending between the upper end portion of the frame and the lower end portion of the frame for blocking golf balls hit by a first golfer from hitting a second golfer practicing next to the first golfer on the opposite side of the tee divider, and a fastening rope for attaching the deflector sheet to the frame.

12 Claims, 1 Drawing Sheet

DRIVING RANGE TEE AREA DIVING METHOD

BACKGROUND OF THE INVENTION

1. Field of the Invention

The present invention relates to a tee divider for dividing the tee area of a golf driving range into subsections and for blocking golf balls laterally projected from the tee area of a golf driving range or a tee area of a golf course.

2. Description of the Prior Art

At a typical driving range, numerous golfers line up closely adjacent to one another in a straight or slightly curved row relative to a common range or field. At driving ranges providing only driving range services (hereinafter "commercial" driving ranges), individual "stalls" are provided along the row from which individual golfers may drive golf balls into the common range or field. The tee area of each stall typically is provided with artificial grass or plastic turf from which the golf balls are struck. The stalls are divided from one another by fixed, rigid dividers made of either cement, wood, metal or some other fixed, impact-resistant material. The dividers are designed to prevent "shanked" or laterally projected golf balls from striking adjacent golfers or spectators; however, the rigid construction of such dividers often indirectly causes injury to the golfer, adjacent golfers or spectators when shanked shots ricochet off the impact-resistant walls of the dividers. Therefore, it would be desirable to provide a tee divider which is impact-absorbent to prevent laterally projected or shanked golf balls from ricocheting off the tee divider towards the golfer and adjacent golfers and spectators.

Many public and private golf courses also provide driving ranges as an annex to the golf course (hereinafter "course" driving range) for "warming up" before play or for practice. Such course driving ranges have a designated tee area from which golfers are required to hit golf balls, but typically do not provide individualized stalls having fixed, rigid dividers separating adjacent golfers. Fixed, rigid dividers are not practical since, contrary to commercial driving ranges, the designated tee area of course driving ranges comprises real grass which wears out throughout the golf season. Once the grass in the designated tee area becomes unacceptably worn, the designated tee area is moved, usually forward or backward relative to the range itself. Due to this necessary movement, fixed, rigid tee dividers, such as those provided at commercial driving ranges, would be impractical at course driving ranges. Therefore, it would also be desirable to provide a tee divider which is lightweight and easily movable from one section of a tee surface to another.

During play of golf, the initial tee shot or drive is typically likely to be a golfer's most errant tee shot since the golfer may not be fully warmed-up and ready to play. Accordingly, his initial tee shot is potentially the most dangerous since it is the likeliest tee shot to be severely shanked or laterally projected, possibly causing injury to other golfers or spectators near the tee area or damaging property near the tee area. Typically, golf courses do not provide a barrier or divider at the tee area to guard against such errantly hit shots for several reasons. Like course driving ranges, the designated tee area on each hole of a golf course is not fixed, but rather is moved frequently due to turf wear. Further, fixed dividers or barriers would detract from the aesthetic beauty of most golf courses. Therefore, it would further be desirable to provide a tee divider which is aesthetically attractive and visually acceptable at the tee area of a golf course.

SUMMARY OF THE INVENTION

It is an object of the invention to provide a tee divider which is impact-absorbent to prevent laterally projected or shanked golf balls from ricochetting off the tee divider towards the golfer and adjacent golfers and spectators.

Another object of the invention is to provide a tee divider which is lightweight and easily movable from one section of a tee area to another, when desired.

Still another object of the invention is to provide a tee divider which is aesthetically attractive and visually acceptable at the tee area of a golf course.

These and other objects are accomplished by providing a tee divider constructed in accordance with the invention for blocking golf balls shanked or laterally projected from the tee areas of driving ranges and golf courses.

The tee divider of the present invention preferably comprises a three-sided or toppled U-shaped frame defining a trapezoidal area therebetween. The trapezoidal area is defined on three sides by the frame and on a fourth side by the opposed ends of said frame. The frame has mounting feet on the bottom side for securing the divider to the tee area and supporting the divider in an upright position transverse to the plane of the tee area. The divider also has a deflector sheet positioned in and generally conforming to the trapezoidal area. The deflector sheet is provided with a plurality of eyelets formed in its periphery, and the deflector sheet is secured in place in the trapezoidal area defined by the frame by a cord or fastening rope that extends through an eyelet and around a portion of the frame, through the next eyelet and around another portion of the frame, and so on.

The deflector sheet of the divider comprises a lightweight, impact absorbent material which prevents a golf ball from ricocheting off the tee divider back at the golfer who hit the ball or other golfers or spectators in the vicinity of the tee area. The lightweight material is removably secured to the frame for easy replacement due to wear or other reasons.

The divider has a rear support section and a front ball-blocking section the divider defines a ball hitting area, that is, a subsection of a range, adjacent said divider, said ball hitting area having a length equal to the length of the front ball-blocking section of the tee divider. Due to the construction of the tee divider, the entirety of the frame in the front ball-blocking section of the tee divider forms a forward angle of impact greater than zero with any point in the ball hitting area. This construction significantly reduces the risk of injury to the golfer since the only impact resistant surfaces capable of deflecting the ball back at the golfer hitting the ball are located behind the golfer in the rear support section of the tee divider.

DETAILED DESCRIPTION OF THE DRAWINGS

Figure 1:
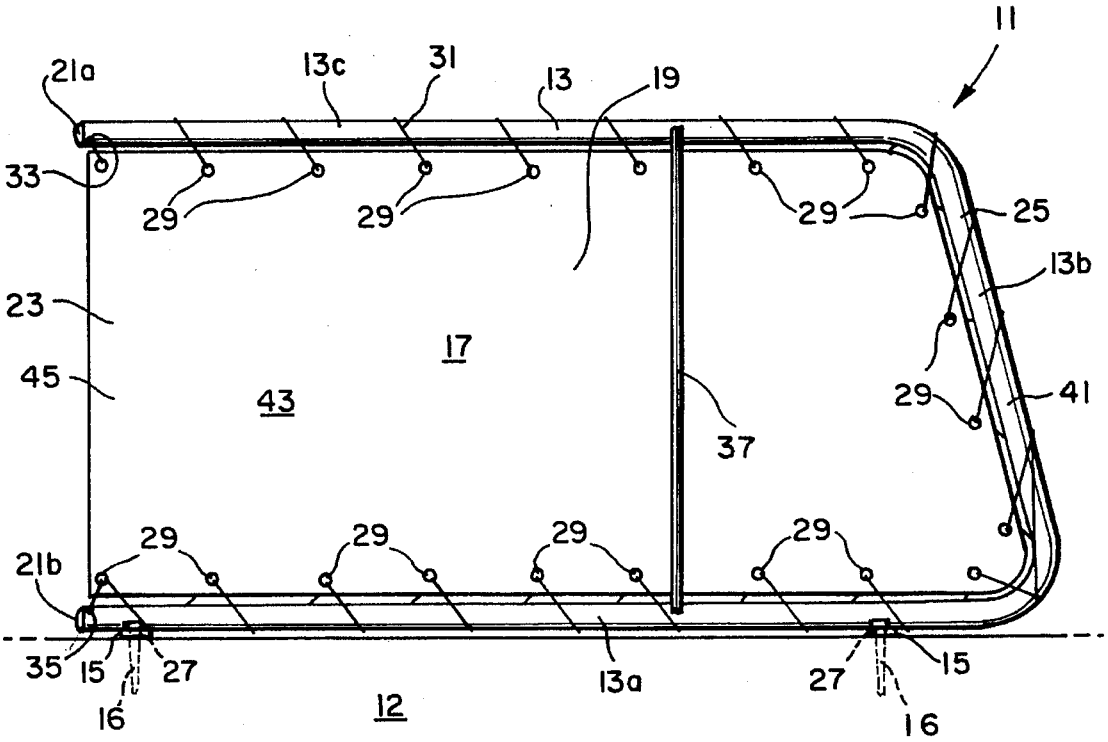
FIG. 1 is a front elevational view of a preferred embodiment of the tee divider constructed in accordance with the invention; and, FIG. 2 is a top plan view of the tee divider of FIG. 1.

Turning now to the drawings, there is shown in FIG. 1 a tee divider 11 for dividing a tee area 12 of a golf driving range into subsections and for blocking golf balls hit by a first golfer from hitting a second golfer practicing next to the first golfer. The tee divider 11 comprises a frame 13 having an upper end portion and a lower end portion, mounting feet 15 mounted on the lower end portion of frame 13 for securing the tee divider 11 on the tee area and for supporting the tee divider 11 in an upright position substantially perpendicular to the plane of the tee area 12, a deflector sheet 17 extending between the upper end portion of the frame 13 and the lower end portion of the frame 13 for blocking golf balls hit by a first golfer from hitting a second golfer practicing next to the first golfer, and attachment means for attaching the deflector sheet 17 to the frame 13.

As shown in FIG. 1, frame 13 defines a geometrically-shaped area 19 across which deflector sheet 17 extends. In the embodiment of the invention illustrated in the drawings, the geometrically-shaped area 19 defined by frame 13 is trapezoidal.

Frame 13 has substantially a toppled U-shape, and preferably comprises a tube formed from a single, continuous, lightweight, ten feet long tubular material such as aluminum or plastic having a circular cross-section that it bent at various points along its length to form a bottom leg portion 13*a* which rests on or just above the surface of the tee area 12, an upwardly extending side leg portion 13*b*, and a top leg portion 13*c* which runs parallel to the bottom leg portion 13*a*. Preferably, the tube of frame 13 has a diameter of 1¾ inches.

End caps 21*a* and 21*b* are provided at the two ends of the tube of frame 13.

In the embodiment shown in the drawings, two mounting feet 15 are provided. A first foot 15 is fixed to bottom leg 13*a* near the front end portion 23 of the tee divider 11, preferably by bolting or welding. Likewise, a second mounting foot 15 is fixed on bottom leg 13*a* near the back end portion 25 of tee divider 11, again preferably by bolting or welding. Preferably, the dimensions of each mounting foot 15 are 0.75 inches by 1½ inches by 6 inches. Mounting feet 15 have apperatures 27 formed therein for receiving mounting members 16 (e.g., spikes, screws, bolts, etc.) which pass through the mounting feet 15 and into the tee area 12 to secure the tee divider 11 to the tee area 12.

The divider sheet 17 is made of an impact-absorbent material, such as a sheet of mesh, vinyl, or duck fabric. The deflector sheet 17 is strong enough to block a golf ball that has been shanked but sufficiently impact-absorbent to prevent the ball from ricocheting at high speed back at the golfer who hits the golf ball or golfers and spectators in the vicinity of the tee area 12.

Deflector sheet 17 is removable fastened to and supported by the frame 13 on all sides but one. As shown in FIG. 1, deflector sheet 17 has a plurality of eyelets 29 formed in its periphery, and a fastening rope 31 extends serially through each eyelet 29, the fastening rope 31 being wrapped around the frame 13 between each eyelet 29. The first free end of fastening rope 31 extends through a small apperature 33 formed near end cap 21*a*, where the first free end of fastening rope 31 is knotted. Likewise, the second free end of fastening rope 31 extends through a small apperature 35 formed in the frame 13 near end cap 21*b*, where the second free end of fastening rope 31 is knotted. The end caps 21*a* and 21*b* are pressed into position after the deflector sheet 17 has been secured in place by the fastening rope 31.

Optionally, a vertical strut 37 is mounted on, preferably by welding, and extends between bottom leg portion 13*a* and top leg portion 13*c* of frame 13 for providing rigidity to the frame 13. The strut 37 is located toward the back end portion 25 of the tee divider 11 and preferably behind the point where a golfer hits golf balls, thereby limiting the chances of a golf ball deflecting off the strut 37 into the golfer or spectators. Preferably, the strut 37 is aluminum.

Referring to FIG. 1, the tee divider 11 has two zones, a rear support section 41 and a front ball-blocking section 43. When the inventive tee divider 11 includes strut 37, the rear support section 41 extends from strut 37 to the back end portion 25 of the tee divider 11, and the front ball-blocking section 43 extends from forward of the strut 37 to the front end portion 23 of the tee divider 11. Ideally, a golfer hits balls from a position forward of the location of strut 37. From this position, the risk of injury to the golfer hitting the ball is substantially reduced since the tee divider 11 of the preferred embodiment of the invention shown in the drawings is constructed such that in the front ball-blocking section 43 there is no surface capable of deflecting the ball back towards the golfer. This safety feature results from the deflector sheet 17, which is made of an impact-absorbent material, and further from the construction of the frame 13, in particular, the unsupported front end portion 45 of deflector sheet 17. Because the tee divider 11 of the preferred embodiment of the invention shown in the drawings has no rigid support, i.e., a portion of the frame 13, extending parallel to the unsupported front end portion 45 of deflector sheet 17, a ball striking the front end portion 45 of deflector sheet 17 does not ricochet back at the golfer. Further, the tubular construction of the top leg portion 13*c* and the bottom leg portion 13*a* deflect the ball away from the golfer. The only impact resistant surfaces capable of deflecting the ball back at the golfer are located behind the golfer in the rear support section 41 of the tee divider 11. Even if a golfer hits balls from opposite the rear support section 41 of tee divider 11, the chances of being hit by a ricocheting ball are small since most of the area of the rear support section 41 comprises a portion of the deflector sheet 17, which deadens any golf ball hit into it.

When the inventive tee divider 11 does not include strut 37, the rear support section 41 comprises side leg portion 13*b* and the front ball-blocking section 43 extends from forward of side leg portion 13*b* to the front end portion 23 of the tee divider 11.

Alternatively, the shape of the frame 13, as well as the corresponding shape of the deflector sheet 17, may be geometric shapes other than a trapezoid. However, with these alternative frames 13 and deflector sheets 17, it is preferred that the front end portion of the tee divider 11 be frameless so that there is no rigid support along the front end portion of the tee divider 11 against which a ball struck by a golfer may ricochet back at the golfer off such a support.

Also, alternatively, the fastening rope 31 may be replaced by hooks, clamps, or similar fastening hardware to secure deflector sheet 17 to frame 13.

Although not shown in the drawings, deflector sheet 17 may be embossed with a logo, such as a golf club insignia, a commercial endorsement, a sponsorship recognition, or a tournament title. Since the deflector sheet 17 is easily removable from frame 13 by unfastening the fastening rope 31, the deflector sheet 17 may be quickly and easily replaced with another deflector sheet 17 having the appropriate embossment for another outing or tournament.

Preferably, the height of the tee divider 11 is about 27½ inches, and the length of the tee divider is about 54 inches.

The tee divider 11 of the present invention may be used on the tee of a golf course for blocking errantly hit golf balls shanked or hit laterally from the tee. Preferably, a pair of tee dividers 11 may be provided, one on each side of the tee, to accommodate both left-handed and right-handed golfers.

A method of dividing a tee area 12 of a golf driving range into subsections and/or for blocking golf balls hit by a first golfer from hitting other golfers or spectators in the path of a shanked or laterally projected golf ball hit by the first golfer, comprises the steps of providing a tee divider 11 constructed in accordance with the invention, positioning the tee divider 11 on the tee area 12 to divide the tee area into a subsection or to form a lateral border to the tee area 12, forming a hitting area on the tee area 12 adjacent to the tee divider 11 for hitting golf balls, and blocking laterally hit golf balls with the tee divider 11, thereby preventing laterally hit golf balls from hitting golfers and spectators standing beyond the tee divider 11.

With course driving ranges and tee areas on a golf course, because frame 13 preferably comprises lightweight tubing, tee divider 11 is not heavy and is easy to carry to and secure at a new location on the tee area 12 when it is desired to change the position on the tee area 12 from which golf balls are hit.

Figure 2:
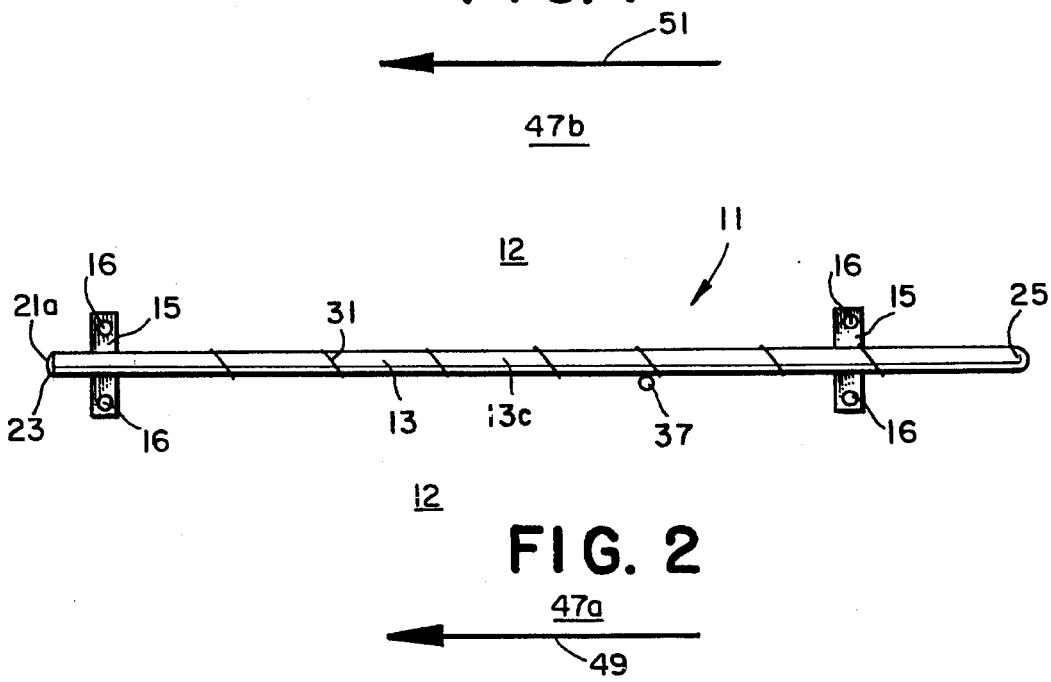

The tee divider 11 establishes hitting areas 47*a* and 47*b* adjacent to the tee divider 11 from which balls may be hit. For a right-handed golfer, balls are hit from the hitting area 47*a* in the direction indicated by the arrow 49 shown in FIG. 2. For a left-handed golfer, balls are hit from the hitting area 47*b* in the direction indicated by arrow 51 shown in FIG. 2. Accordingly, shots hit by a golfer from the hitting areas 47*a* and 47*b* in the proper direction, that is, in the direction shown by arrows 49 and 51 of FIG. 2, are not affected by and do not come into contact with the tee divider 11. However, laterally hit or shanked golf balls are blocked by tee divider 11.

The inventive tee divider 11 acts as a safety device for protecting golfers and spectators from injury and property from damage caused by being hit by a laterally hit or shanked golf ball by blocking such an errantly hit ball before it reaches the golfers, spectators, or property. The force of such an errantly hit shot hit into the deflector sheet 17 is absorbed. Accordingly, such an errantly hit ball does not directly strike golfers, spectators and property located beyond the tee divider 11 or indirectly strike, by ricochetting off the deflector sheet 17, golfers, spectators, and property located in the vicinity of the tee divider 11.

We claim:

1. The method of dividing a tee area of a golf driving range into subsections and/or for blocking golf balls hit by a first golfer from hitting other golfers or spectators in the path of a shanked or laterally projected golf ball hit by the first golfer, comprises the steps of providing a tee divider having a frame having substantially a toppled U-shape, the frame comprising a tube having a circular cross-section and being bent at various points along its length to form a bottom leg portion, a side leg portion, and a top leg portion of the frame, mounting feet mounted on the bottom leg portion of the frame for securing the tee divider on the tee area and for supporting the tee divider in an upright position substantially perpendicular to the plane of the tee area, a deflector sheet, which is impervious to golf balls, extending substantially across the entire area formed by the frame for blocking golf balls that are shanked or laterally hit by a golfer, and attachment means for attaching the deflector sheet to the frame, positioning the tee divider on the tee area so that said side leg portion is vertically oriented and positioned rearwardmost on the tee area to divide the tee area into subsections or to form a lateral border to the tee area, forming a hitting area on the tee area adjacent to the tee divider for hitting golf balls, and blocking laterally hit golf balls hit from the hitting area with the tee divider, thereby preventing laterally hit golf balls from hitting golfers and spectators standing beyond the tee divider.

2. The method of claim 1, the frame defining a geometrically-shaped area, and the deflector sheet extending substantially across the entire geometrically-shaped area formed by the frame.

3. The tee divider of claim 2, the geometrically-shaped area being trapezoidal.

4. The method of claim 1, the frame having substantially a toppled U-shape, the frame comprising a tube having a circular cross-section and being bent at various points along its length to form a bottom leg portion, a side leg portion, and a top leg portion.

5. The tee divider of claim 4, further including a vertical strut mounted on and extending between the bottom leg portion of the frame and the top leg portion of the frame for providing rigidity to the frame, the strut being located behind a point where the first golfer hits golf balls, thereby limiting the chances of a golf ball deflecting off the strut into the golfer or spectators.

6. The method of claim 1, the tee divider having front end portion and a back end portion, the first mounting foot being mounted near the front end portion of the tee divider, and further including a second mounting foot mounted on the lower end portion of the frame near the back end portion of the tee divider for securing the tee divider on the tee area and for supporting the tee divider in a upright position substantially perpendicular to the plane of the tee area.

7. The tee divider of claim 6, the first foot and the second foot each having apertures formed therein for receiving mounting spikes which pass through the first foot and the second foot and into the ground to secure the tee divider to the tee area.

8. The method of claim 1, the first foot having apperatures formed therein for receiving mounting spikes which pass through the first foot and into the ground to secure the tee divider to the tee area.

9. The method of claim 1, the divider sheet comprising a impact-absorbent material.

10. The method of claim 1, the divider sheet comprising a sheet of mesh, vinyl, or duck fabric.

11. The method of claim 1, the attachment means including a plurality of eyelets formed in the periphery of the deflector sheet, and a fastening rope that extends serially through each eyelet, the rope being wrapped around the frame between each eyelet.

12. The method of claim 1, the frame defining a geometrically-shaped area, and the deflector sheet extending substantially across the entire geometrically-shaped area formed by the frame, the frame having substantially a toppled U-shape, the frame comprising a tube having a circular cross-section and being bent at various points along its length to form a bottom leg portion, a side leg portion, and a top leg portion, the tee divider having front end portion and a back end portion, the first mounting foot being mounted near the front end portion of the tee divider, and further including a second mounting foot mounted on the lower end portion of the frame near the back end portion of the tee divider for securing the tee divider on the tee area and for supporting the tee divider in a upright position substantially perpendicular to the plane of the tee area, the first foot and the second foot each having apertures formed therein for receiving mounting spikes which pass through the first foot and the second foot and into the ground to secure the tee divider to the tee area, the divider sheet comprising a impact-absorbent material, the divider sheet comprising a sheet of mesh, vinyl, or duck fabric, the attachment means including a plurality of eyelets formed in the periphery of the deflector sheet, and a fastening rope that extends serially through each eyelet, the rope being wrapped around the frame between each eyelet, a vertical strut mounted on and extending between the bottom leg portion of the frame and the top leg portion of the frame for providing rigidity to the frame, and the strut being located behind a point where the first golfer hits golf balls, thereby limiting the chances of a golf ball deflecting off the strut into the golfer or spectators.

* * * * *